United States Patent [19]

Sheu

[11] Patent Number: 4,731,718

[45] Date of Patent: Mar. 15, 1988

[54] CHRISTMAS LAMP

[76] Inventor: Rong-Fu Sheu, No. 15, Bair Sha, Hsin Chu, Taiwan

[21] Appl. No.: 18,711

[22] Filed: Feb. 25, 1987

[51] Int. Cl.[4] ..... F21V 35/00

[52] U.S. Cl. ..... 362/392; 362/810

[58] Field of Search ..... 362/810, 806, 392; D26/9, 16, 22

[56] References Cited

U.S. PATENT DOCUMENTS

| | | | |
|---|---|---|---|
| 985,234 | 2/1911 | Wagner | 362/810 |
| 1,783,277 | 12/1930 | Block | 362/810 |
| 1,831,443 | 11/1931 | Goldman | 362/810 |
| 2,061,824 | 11/1936 | Beymer | 362/810 |
| 2,710,912 | 6/1955 | Holm | 362/392 |
| 2,726,322 | 12/1955 | Alperin et al. | 362/392 |
| 2,782,296 | 2/1957 | Walter | 362/810 |
| 3,500,126 | 3/1970 | Ford | 362/810 |
| 4,298,923 | 11/1981 | Lin | 362/806 |
| 4,590,545 | 5/1986 | Scheer | 362/810 |

FOREIGN PATENT DOCUMENTS

| | | | |
|---|---|---|---|
| 2617450 | 11/1977 | Fed. Rep. of Germany | 362/810 |
| 615000 | 1/1961 | Italy | 362/810 |

*Primary Examiner*—William A. Cuchlinski, Jr.
*Assistant Examiner*—D. M. Cox
*Attorney, Agent, or Firm*—Bacon & Thomas

[57] ABSTRACT

This invention relates to an improved Christmas lamp comprising a candlelike cylinder, a stand and several electric wires. The bulb socket is made into an integrated part of the candlelike cylinder. With a double-slope flange on the lower end of the candlelike cylinder and several projections on the internal surface of the stand, the candlelike cylinder will not turn after it is fitted in the stand and broken cord and short circuit can be avoided. The electric wires equipped with metal strips are connected in such way that the circuit will be open when the cylinder is removed from the stand and it is very easy to assemble and repair.

1 Claim, 3 Drawing Figures

A-A

CHRISTMAS LAMP

BACKGROUND AND SUMMARY OF THE INVENTION

A conventional Christmas lamp now available has its candlelike cylinder fitted in its stand, and its cord connected to the socket on the top of the candlelike cylinder and coming through the cylinder and out of the stand for connecting with the power line. Since this Christmas lamp is usually kept in the house as an ornament, it is often played by the childran as a toy. When playing, the children will remove the candlelike cylinder from the stand or turn the candlelike cylinder in the stand. Thus, the cord in the cylinder will be broken and short circuit or shock will occur. This is because the candlelike cylinder is simply fitted in the stand without any locking or safety device to prevent the danger from occurring.

In view of this. the inventor developed an improved christmas lamp which has a double-slope flange and grooves at the lower end of the candlelike cylinder, and projections on the internal surface of the stand, and other safety devices to prevent the children from turning or removing the candlelike cylinder from the stand so as to protect the children from getting a shock.

DETAILED DESCRIPTION OF THE PREFERRED EMBODIMENT

Figure 1:
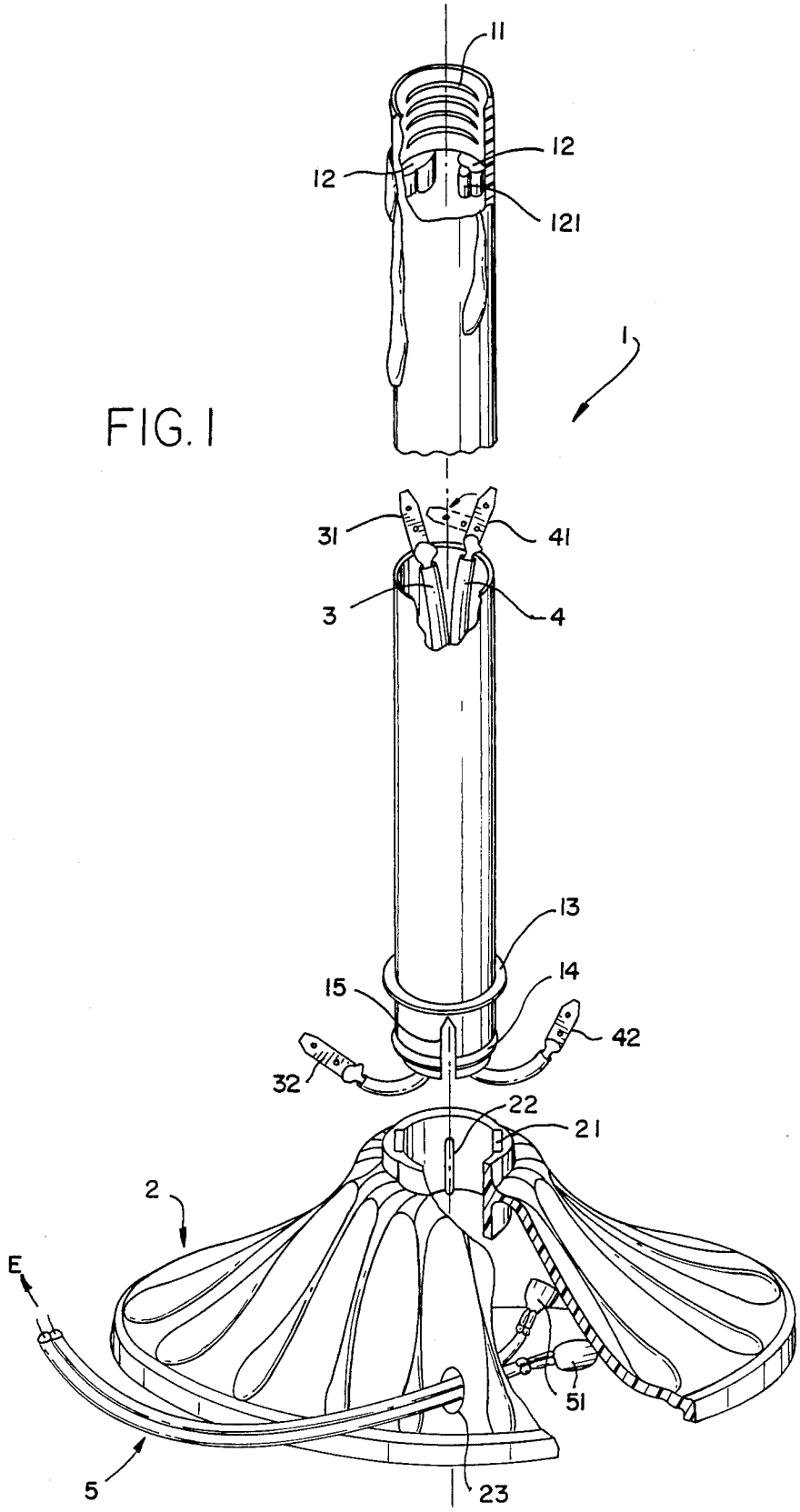
FIG. 1 is an exploded view of the improved Christmas lamp of this invention with some cutaways.
Figure 3:
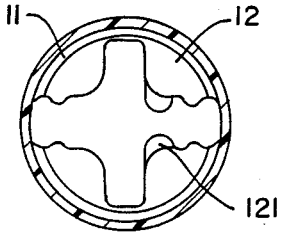
FIG. 3 is a cross-sectional view of the Christmas lamp taken along line A—A of FIG. 2.

As shown in FIG. 1, the improved Christmas lamp of this invention comprises a candlelike cylinder 1, a stand 2 and electric wires 3,4,5. The candlelike cylinder 1 has an interrupted internal thread 11 at the top end, several curved projections 12 under the thread 11 several small cylindrical projections 121 on some of the curved projections 12 a collar 13 at the lower end, several vertical grooves 15 and a double-slope flange 14. The stand 2, a cuplike hollow object, has two grooves 21 in the top cylindrical wall and several vertical projections 22 on the same wall and a cord hole 23 near the bottom. The electric wires 3,4 are equipped with metal strips 31,41,32,42 respectively at the ends. The cord 5, a combination of two electric wires, is equipped with metal strips 5 at the end and connected to the power line.

Figure 2:
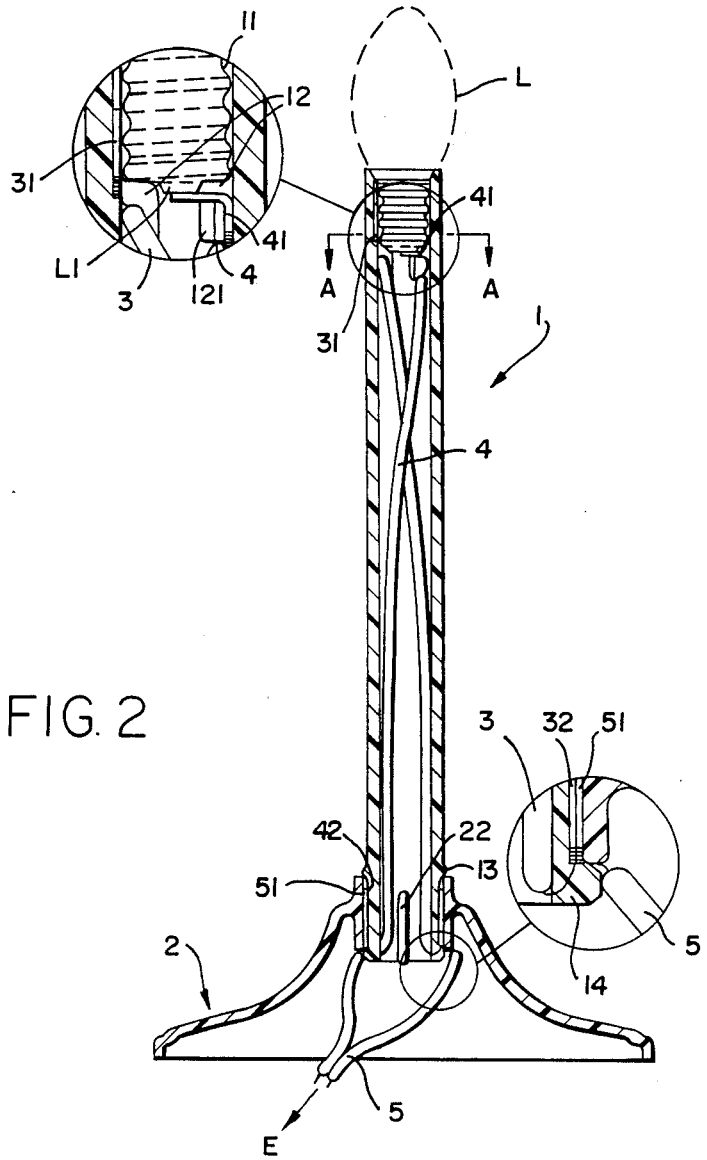
FIG. 2 is a sectional view of the said Christmas lamp with some details.

As shown in FIG. 2, the electric wire 3 fitted in the candlelike cylinder 1 has its metal strip 31 at the top end snapped in the cut flat part of the thread 11 and confined in the curved projections 12, and another metal strip 32 at the lower end attached to the external surface of the bottom of the candlelike cylinder 1. Another electric wire 4 has its metal strip 41 at the top end bent at a desired angle, confined in the curved projections 12 under the internal thread 11 of the candlelike cylinder 1, and another metal strip 42 attached to the external surface of the bottom of the candlelike cylinder opposite to the metal strip 32. The above is called the first assembly. In the second assembly, the two metal strips of the cord 5 are set in the grooves 21 of the stand. The other end of the cord 5 coming out of the cord hole is connected to the power line. When the lower end of the candlelike cylinder 1 is inserted in the opening of the stand 2, the first assembly is held by the double-slope flange 14 without fear of falling off. And the candlelike cylinder 1 will not fall off the stand 2 unless it is pulled by force. The grooves 15 in the lower end of the candlelike cylinder 1 is designed to be fitted on the internal projections 22 of the stand 2 to prevent the candlelike cylinder 1 from turning in the stand 2. The grooves 15 are also provided to allow the lower end of the candlelike cylinder 1 to reduce and snap in the stand 2 so that the candlelike cylinder, will not be easily removed from the stand 2. After the first and second assemblies are fitted, the circuit is completed and after the bulb L is fitted in the upper end of the candlelike cylinder 1, its negative pole keeps in contact with the thread 11 of the top end of the candlelike cylinder 1 and the lower end L1 of the bulb L keeps in contact with the metal strip 41 of the electric wire 4. Thus, the circuit is closed. To prevent poor contact resulted from elastic fatigue after long use, several small cylindrical projections 121 are added to the curved projections 12 to support the metal strips 41 so that they will not bend downward. With the above mentioned structure, no conventional socket is required and a variety of designs can be made depending on the size of bulbs and the type of lamps. In addition to saving material and processing process, it offers easy maintenance and excellent contact.

I claim:

1. An improved Christmas lamp comprising a candlelike cylinder, a stand and several electric wires, each electric wire being provided with a metal strip at both ends thereof, one of the metal strips being bent; said candlelike cylinder having an interrupted internal thread at the top, several curved projections under the thread to act as a support of the bulb, several small cylindrical projections on the curved projections to prevent the bent metal strip from being pressed down by the lower end of the bulb, a collar acting as an inserting stop of the candlelike cylinder, a double-slope flange to be retained by the lower ends of the projections of the stand as a means to removably fix the candlelike cylinder in the stand, and several grooves in the lower end under the collar to fit on the projections of the stand to prevent the candlelike cylinder from turning axially in the stand and to enable the lower end of the candlelike cylinder to reduce and to snap in the stand; said stand having two grooves and several projectons to retain the candlelike cylinder together with the collar and double-slope flange of the cylinder, and two grooves for the metal strips of the electric wires to fit in; said electric wires fitted with metal strips being connected to complete a circuit.

* * * * *